US007823648B2

(12) United States Patent
Bolding et al.

(10) Patent No.: US 7,823,648 B2
(45) Date of Patent: Nov. 2, 2010

(54) DOWNHOLE SAFETY VALVE APPARATUS AND METHOD

(75) Inventors: Jeffrey L. Bolding, Kilgore, TX (US); David Randolph Smith, Kilgore, TX (US)

(73) Assignee: BJ Services Company, U.S.A., Houston, TX (US)

( * ) Notice: Subject to any disclaimer, the term of this patent is extended or adjusted under 35 U.S.C. 154(b) by 530 days.

(21) Appl. No.: 11/664,646

(22) PCT Filed: Oct. 7, 2005

(86) PCT No.: PCT/US2005/035601

§ 371 (c)(1),
(2), (4) Date: Feb. 27, 2008

(87) PCT Pub. No.: WO2006/041811

PCT Pub. Date: Apr. 20, 2006

(65) Prior Publication Data

US 2008/0164035 A1 Jul. 10, 2008

Related U.S. Application Data

(60) Provisional application No. 60/522,498, filed on Oct. 7, 2004.

(51) Int. Cl.
*E21B 34/10* (2006.01)

(52) U.S. Cl. ..... 166/375; 166/65.1; 166/322; 166/386

(58) Field of Classification Search ..... 166/375, 166/386, 65.1, 322, 68, 105
See application file for complete search history.

(56) References Cited

U.S. PATENT DOCUMENTS

| | | | | |
|---|---|---|---|---|
| 12,143 | A | 1/1855 | Tucker | |
| 2,416,842 | A | 3/1947 | O'Leary | 166/1 |
| 4,022,273 | A | 5/1977 | Marathe | 166/65 |
| 4,387,767 | A | 6/1983 | Read | 166/72 |
| 4,490,095 | A | 12/1984 | Soderberg | |
| 4,616,981 | A | 10/1986 | Simmons et al. | |

(Continued)

FOREIGN PATENT DOCUMENTS

CA 2310236 12/2001

(Continued)

OTHER PUBLICATIONS

Office Action issued in related Canadian Patent Application No. 2583443 dated Jun. 8, 2009.

(Continued)

*Primary Examiner*—Hoang Dang
(74) *Attorney, Agent, or Firm*—Zarian Midgley & Johnson PLLC

(57) ABSTRACT

The application discloses a valve, which may include either a safety valve or a storm surge choke valve or the like, to isolate a zone below a valve from a string of production tubing. Preferably, the valve includes a flow interruption surface assembly, such as a flapper valve or a ball valve, displaced by an operating conduit extending from a surface location to the valve through the inside of the production tubing. The application also discloses a bypass-conduit inside the production tubing to allow communication from a surface location to the production zone when the valve is in either an open or a closed location.

53 Claims, 4 Drawing Sheets

U.S. PATENT DOCUMENTS

| | | | |
|---|---|---|---|
| 4,646,827 | A | 3/1987 | Cobb |
| 5,092,400 | A | 3/1992 | Jagert |
| 5,148,865 | A | 9/1992 | Reed |
| 5,203,409 | A | 4/1993 | Seid et al. |
| 5,522,464 | A | 6/1996 | Piper |
| 5,662,169 | A | 9/1997 | Hosie |
| 5,727,631 | A | 3/1998 | Baker et al. |
| 5,915,475 | A | 6/1999 | Wells et al. |
| 6,467,541 | B1 | 10/2002 | Wells |
| 6,688,386 | B2 | 2/2004 | Cornelssen et al. |
| 6,715,554 | B1 | 4/2004 | Cunningham et al. |
| 6,851,478 | B2 | 2/2005 | Cornelssen et al. |
| 7,025,132 | B2 | 4/2006 | Kent et al. |
| 7,325,600 | B2 | 2/2008 | Sieben |
| 7,699,099 | B2 | 4/2010 | Bolding et al. |
| 2002/0000315 | A1 | 1/2002 | Kent et al. |
| 2002/0134548 | A1 | 9/2002 | Lam et al. |
| 2004/0112604 | A1 | 6/2004 | Milberger et al. |
| 2004/0154790 | A1 | 8/2004 | Cornelssen et al. |
| 2004/0262010 | A1 | 12/2004 | Milberger |
| 2005/0022998 | A1 | 2/2005 | Rogers, Jr. |
| 2005/0175476 | A1 | 8/2005 | Patterson |
| 2005/0249613 | A1 | 11/2005 | Jordan et al. |
| 2006/0008364 | A1 | 1/2006 | Traylor |
| 2008/0029271 | A1 | 2/2008 | Bolding et al. |

FOREIGN PATENT DOCUMENTS

| | | |
|---|---|---|
| CA | 2497090 | 8/2006 |
| EP | 0637675 | 2/1995 |
| GB | 2377954 | 1/2003 |
| WO | WO9821445 | 5/1998 |
| WO | WO9904137 | 1/1999 |

OTHER PUBLICATIONS

PCT International Search Report and Written Opinion corresponding to PCT/US2005/035601, dated Oct. 12, 2006.
Search Report & Written Opinion dated Oct. 12, 2006 from PCT/US2005/35601.
Examiner's Second Examination Report dated Mar. 22, 2010 from related AU Patent Application No. AU2006279282.
Examiner's First Report dated Nov. 2, 2009 from related AU Patent Application No. AU2006279282.
First Exam Report dated Nov. 23, 2009 from related CA Patent Application No. 2619570.
Search Report and Written Opinion dated Sep. 27, 2007 from PCT Application No. PCT/US2006/32504.
Office Action dated Feb. 1, 2010 from related U.S. Appl. No. 11/463,937.
Final Office Action dated Sep. 16, 2009 from related U.S. Appl. No. 11/463,937.
International Preliminary Report on Patentability dated Feb. 12, 2009 from related PCT Application No. PCT/US2007/017226.
International Search Report & Written Opinion dated Jan. 18, 2008 from related PCT Application No. PCT/US2007/017226.
Office Action dated Mar. 13, 2009 from related U.S. Appl. No. 11/461,858.
Office Action dated Aug. 4, 2008 from related U.S. Appl. No. 11/461,858.
Office Action dated Apr. 17, 2007 from U.S. Appl. No. 11/057,214.
Office Action dated Jun. 19, 2009 from related U.S. Appl. No. 11/461,858.
Office Action dated Dec. 31, 2008 from related U.S. Appl. No. 11/461,858.
"Conventional DHSV Coiled Tubing Completion" obtained from http://www.pedcor.com/wellhead-equipment/conventional_dhsv_ct_completion.html, 3-pgs.
"RF Hanger from PEDCOR " obtained from http://www.pedcor.com/wellhead-quipment/rf_hanger.html, 3-pgs.
PEDCOR "Series 10-400 Chemical Injector Adaptor" dated Jan. 5, 1995.
PEDCOR "Wellhead Equipment Sub: Standard Hanger Mandrel Type" obtained from http://www.pedcor.com/wellhead-equipmnet/standard_mandrel_hanger.html, 3-pgs.
Select Energy Systems, "Installation Procedure: Model 2500 CT Hanger", undated, obtained from http://www.selectesi.com/select_energy/PDFs/02.pdf, 2-pgs.
Select Energy Systems, "Model 2500 Flanged CT Hanger", Publisher: undated, obtained from http://www.selectesi.com/select_energy/PDFs/04.pdf, 1-pg.
Select Energy Systems, "Model 2500R Flanged CT Hanger", Publisher: undated, obtained from http://www.selectesi.com/select_energy/PDFs/01.pdf, 1-pg.
Office Action dated Sep. 15, 2009 from related U.S. Appl. No. 12/208,646.
Office Action dated Mar. 9, 2010 from related U.S. Appl. No. 12/208,646.
International Search Report and Written Opinion dated Apr. 23, 2008 from related PCT Application No. PCT/US2008/050752.
Office Action dated Sep. 15, 2009 from related U.S. Appl. No. 11/972,399.
Office Action dated Mar. 24, 2010 from related U.S. Appl. No. 11/972,399.
Canadian Office Action dated Aug. 13, 2008 from related Canadian Application No. CA 2,497,090.
Office Action dated Oct. 20, 2006 from related U.S. Appl. No. 11/057,214.
U.S. Appl. No. 11/463,937, filed Aug. 11, 2006 in the name of Jeffrey L. Bolding.
U.S. Appl. No. 11/972,399, filed on Jan. 10, 2008, in the name of Jeffrey L. Bolding, et al.
U.S. Appl. No. 12/208,646, filed on Sep. 11, 2008, in the name of Jeffrey L. Bolding, et al.
U.S. Appl. No. 12/420,425, filed Apr. 8, 2009, in the name of Jeffrey L. Bolding.

DOWNHOLE SAFETY VALVE APPARATUS AND METHOD

CROSS-REFERENCE TO RELATED APPLICATION

This application claims the benefit of provisional application U.S. Ser. No. 60/522,498 filed Oct. 7, 2004.

BACKGROUND OF THE INVENTION

The present invention generally relates to subsurface valves. More particularly, the present invention relates to an apparatus and method to operate a subsurface valve with a capillary tube extending from a surface station. More particularly still, the present invention relates to an apparatus and method to operate a subsurface valve with a capillary tube extending from a surface station from within the tubing string upon which the valve is mounted. The valve may be a safety valve, a storm check valve, or a choke valve. The flow interrupting device or valve may be formed from a flapper, a ball valve, or a gate valve or any other type of flow diverting valve assembly which may be actuated from the surface.

Subsurface valves are typically installed in strings of tubing deployed to subterranean wellbores to prevent the escape of fluids from one production zone to another, including the surface. The application of the present invention relates to all types of valves, but for the purposes of this disclosure the illustrative application shall be safety valves used to shut in a well in the absence of continued hydraulic pressure from the surface. This limitation on the scope of this disclosure should not be used to limit the scope of the disclosure for non-safety valve applications which may be readily apparent from the disclosure made herein to a person having ordinary skill in this art.

Absent safety valves, sudden increases in downhole pressure can lead to catastrophic blowouts of production and other fluids into the atmosphere. For this reason, drilling and production regulations throughout the world require safety valves be in place within strings of production tubing before certain operations can be performed.

One popular type of safety valve is known as a flapper valve. Flapper valves typically include a closure member generally in the form of a circular or curved disc that engages a corresponding valve seat to isolate one or more zones in the subsurface well. The flapper disc is preferably constructed such that the flow through the flapper valve seat is as unrestricted as possible. Usually, flapper-type safety valves are located within the production tubing and isolate one or more production zones from the atmosphere or upper portions of the wellbore or production tubing. Optimally, flapper valves function as large clearance check valves, in that they allow substantially unrestricted flow therethrough when opened and completely seal off flow in one direction when closed. Particularly, production tubing safety valves prevent fluids from production zones from flowing up the production tubing when closed but still allow for the flow of fluids (and movement of tools) into the production zone from above.

Flapper valve disks are often energized with a biasing member (spring, hydraulic cylinder, etc.) such that in a condition with zero flow and with no actuating force applied, the valve remains closed. In this closed position, any build-up of pressure from the production zone below will thrust the flapper disc against the valve seat and act to strengthen any seal therebetween. During use, flapper valves are opened by various methods to allow the free flow and travel of production fluids and tools therethrough. Flapper valves may be kept open through hydraulic, electrical, or mechanical energy during the production process.

Examples of subsurface safety valves can be found in U.S. Provisional Patent Application Ser. No. 60/522,360 filed Sep. 20, 2004 by Jeffrey Bolding titled "Downhole Safety Apparatus and Method;" U.S. Provisional Patent Application Ser. No. 60/522,500 filed Oct. 7, 2004 by David R. Smith and Jeffrey Bolding titled "Downhole Safety Valve Apparatus and Method;" U.S. Provisional Patent Application Ser. No. 60/522,499 filed Oct. 7, 2004 by David R. Smith and Jeffrey Bolding titled "Downhole Safety Valve Interface Apparatus and Method;" all hereby incorporated herein by reference.

This application further incorporates by reference U.S. Non-Provisional application Ser. No. 10/708,338 Filed Feb. 25, 2004, titled "Method and Apparatus to Complete a Well Having Tubing Inserted Through a Valve" and U.S. Provisional Application Ser. No. 60/319,972 Filed Feb. 25, 2003 titled "Method and Apparatus to Complete a Well Having Tubing Inserted Through a Valve".

One popular means to counteract the closing force of the biasing member and any production flow therethrough involves the use of a capillary tube to operate the safety valve flapper through hydraulic pressure. Traditionally, production tubing having a subsurface safety valve mounted thereto is disposed down a wellbore to a depth of investigation. In this circumstance, the capillary tubing used to open and shut the subsurface safety valve is deployed in the annulus formed between the outer profile of the production tubing and the inner wall of the borehole or casing. A fitting outside of the subsurface safety valve connects to the capillary tubing and allows pressure in the capillary to operate the flapper of the safety valve.

Furthermore, because former systems were run with the production tubing, installations after the placement of production tubing in the wellbore are invasive. To accomplish this, the production tubing must be retrieved, the safety valve installed, the capillary tubing attached, and the production tubing, safety valve, and capillary tubing run back into the hole. This process is expensive and time consuming, so it is typically performed on wells having enough long-term production capability to justify the expense.

SUMMARY OF THE INVENTION

The present invention is directed to a downhole safety valve apparatus with a bypass-conduit, for example. In one embodiment a valve comprises a flow interruption device operable between an open position and a closed hydraulically sealed position and a bypass-conduit extending from a surface location through the valve to a zone below the valve, the bypass-conduit wholly contained within a bore of a string of tubing carrying the valve. The valve can be a subsurface safety valve or a storm choke valve. The zone below the valve can be a production zone. The flow interruption device can be a flapper. The flapper can be pivotably operable between the open position and the closed hydraulically sealed position.

In another embodiment, the bypass-conduit is in communication with the surface location and the zone below the valve when the flow interruption device is in the closed hydraulically sealed position. The operating conduit can be in communication with a source of an energy, the operating conduit extending from the surface location to the valve and the energy actuating the flow interruption device from the closed hydraulically sealed position to the open position. The bypass-conduit can be a capillary tube. The capillary tube can be a fluid injection capillary tube in communication with the surface location and the zone below the valve. The fluid can be a liquid or gas. In another embodiment, the fluid is selected from the group comprising surfactant, acid, miscellar solution, corrosion inhibitor, scale inhibitor, hydrate inhibitor, and paraffin inhibitor.

In another embodiment the bypass-conduit is a logging conduit, a gas lift conduit, an electrical conductor, or an optical fiber. In yet another embodiment, the bypass-conduit is a hydraulic passage. The bypass-conduit can further comprise a check valve attached below the valve or a check valve attached between the valve and a wellhead.

In another embodiment, the operating conduit is a hydraulic passage. The operating conduit can further comprise a check valve located between the valve and a wellhead. The energy supplied by the operating conduit can actuate a packer element of the valve to an engaged position. The energy supplied by the operating conduit can actuate a packer element of the valve to a disengaged position. The operating conduit can be a continuous tube. The operating conduit can be a capillary tube.

In yet another embodiment, the operating conduit and the bypass-conduit can be concentric. The operating conduit and the string of tubing can be concentric. The bypass-conduit and the string of tubing can be concentric. The valve can further comprise a second operating conduit extending from the surface location to the valve, the second operating conduit in communication with the source of the energy, the energy actuating the flow interruption device from the open position to the closed hydraulically sealed position. The second operating conduit can extend from the surface location to the valve from outside the string of tubing.

In yet another embodiment, a method to communicate with a zone below a valve can comprise installing a valve at a downhole location within a string of tubing, connecting an operating conduit inside a bore of the string of tubing between the valve and a surface location, extending a bypass-conduit wholly contained within a bore of a string of tubing carrying the valve from the surface location, through the valve, and to the zone below the valve, selectively opening and closing a flow interruption device with the operating conduit, and communicating with the zone below the valve via the bypass-conduit when the flow interruption device of the valve is in a closed hydraulically sealed position. The valve can be a subsurface safety valve. The flow interruption device can be a flapper.

In another embodiment, the method can further comprise communicating with the zone below the valve through the bypass-conduit when the flow interruption device of the valve is in an open position. The bypass-conduit can be a continuous tube. The bypass-conduit can be a capillary tube. The method can further comprise constructing the bypass-conduit from a section of jointed pipe deployed from the surface location. The method can further comprise locating a check valve in the bypass-conduit above the valve. The method can further comprise locating a check valve in the bypass-conduit below the valve. The method can further comprise locating a check valve in the operating conduit.

In yet another embodiment, the method can further comprise injecting a foam to the zone below the valve through the bypass-conduit. The method can further comprise injecting a fluid to the zone below the valve through the bypass-conduit. The fluid can be selected from the group consisting of corrosion inhibitor, scale inhibitor, hydrate inhibitor, paraffin inhibitor, surfactant, acid, and miscellar solution. The bypass conduit can be a logging conduit, a gas lift conduit; an electrical conductor, or an optical fiber. The bore of the logging conduit can be greater than one and a half inches in diameter.

In another embodiment, the method can further comprise deploying the string of tubing, the bypass-conduit, the operating conduit, and the valve simultaneously. The method can further comprise deploying the valve, the bypass-conduit, and the operating conduit simultaneously into a pre-existing string of tubing. The valve can be installed by actuating a packer element of the valve. The method can further comprise actuating the packer element with the operating conduit. The method can further comprise actuating the packer element with the operating conduit. The method can further comprise actuating the packer element with the bypass-conduit.

DETAILED DESCRIPTION OF THE PREFERRED EMBODIMENTS

Figure 1:
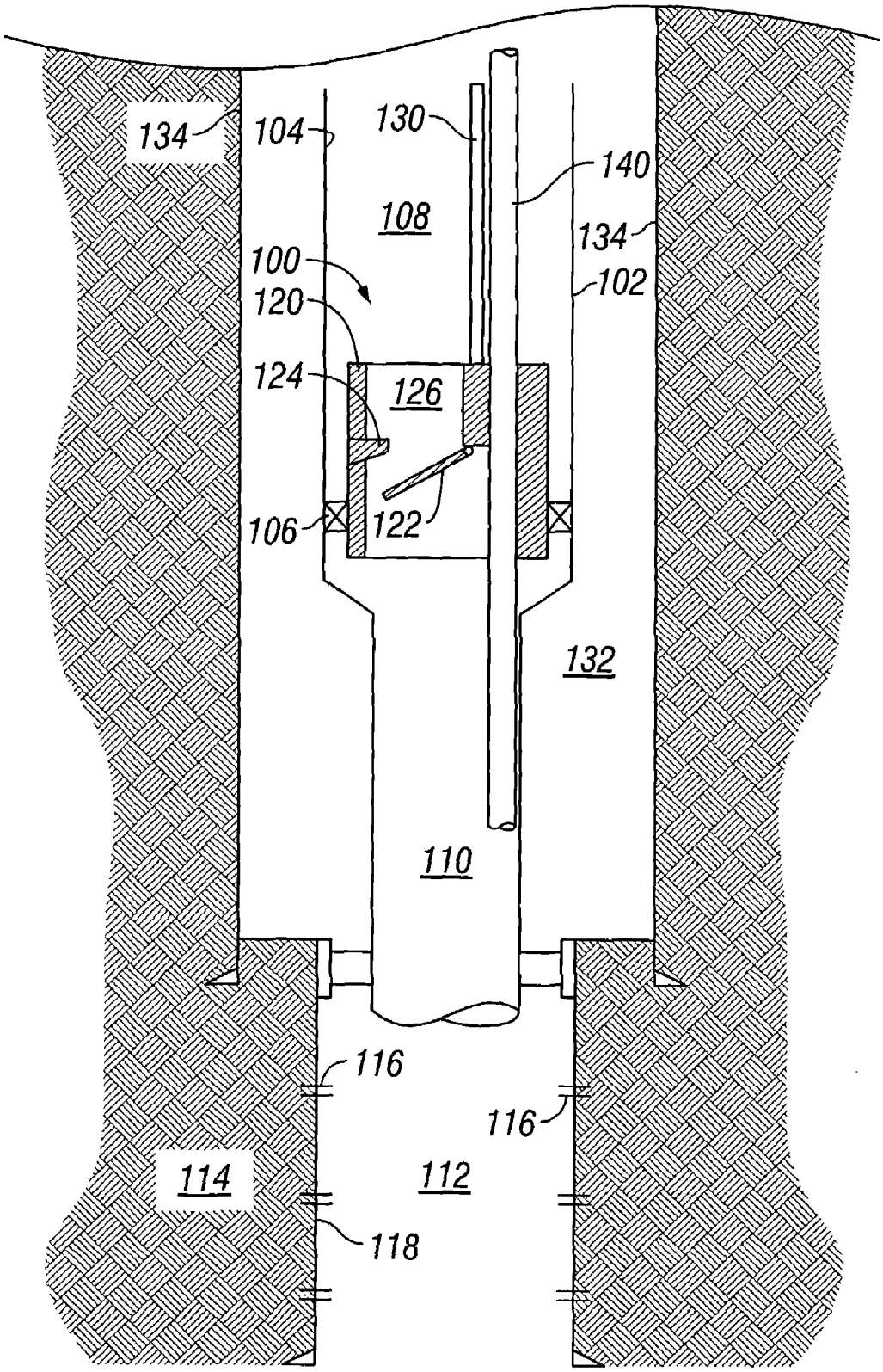
FIG. 1 is schematic representation of a safety valve assembly with a bypass-conduit installed in a string of tubing in accordance with an embodiment of the present invention.

Referring initially to FIG. 1, a safety valve assembly 100 is shown schematically deployed in a string of production tubing 102. Safety valve assembly 100 can be of any valve type known to one of ordinary skill in the art and may be deployed integrally within tubing string 102 or may be held within a bore 104 of tubing 102 and isolated with a hydraulic seal 106. Nevertheless, the safety valve assembly 100 functions to selectively isolate a first zone 108 of tubing 102 from a second zone 110 of tubing 102. Typically, zone 108 is in communication with a surface location (not shown) at the uppermost end of tubing 102 and zone 110 is in communication with one or more production zones 112. To communicate production fluids from the subsurface formation 114 to the surface, production fluids flow through perforations 116 in a production casing or wellbore 118, up through lower zone 110 of production tubing 102, past safety valve 100, through upper zone 108 of tubing 102 and to the surface.

Safety valve assembly 100 acts to prevent flow from lower zone 110 to upper zone 108 and typically includes a valve body 120, a flapper disc 122, a valve seat 124, and a flow bore 126. While a flapper-type design is typical and common for safety valves deployed to subterranean wells, it should be understood that any type of valve assembly known to one skilled in the art may be used. When flapper disc 122 is open, production fluids and other tools and materials are free to flow from zone 108 to zone 110 and vice versa through flow bore 126. However, when flapper disc 122 is closed and in contact with valve seat 124, fluids in zone 110 cannot migrate to zone 108 within production tubing 102. Ideally, flapper disc 122 is biased by a spring (or equivalent) into contact with valve seat 124 so flapper disc 122 will close in the absence of any opening force.

The operation of flapper disc 122 from closed position in engagement with valve seat 124 to open position allowing flow through bore 126 is accomplished through operating conduit 130. Operating conduit 130 extends from the surface through bore 104 of tubing string 102 to safety valve assembly 100. Formerly, operating conduits would extend from the surface to safety valves through an annulus 132 between tubing 102 and wellbore 134, but operating conduit 130 reaches safety valve 100 through the inner bore of tubing string 102. Operating conduit 130 can be of any type and style of conduit known to one skilled in the art and can transmit hydraulic, electrical, pneumatic, and mechanical power from the surface to operate flapper disc 122. Preferably, operating conduit 130 is a hydraulic capillary tube containing fluid at sufficient pressure to operate a cylinder (not shown) in connection with flapper disc 122. When energized, hydraulic pressure in conduit 130 would overcome any biasing force urging flapper disc 122 closed thereby opening flapper disc 122. Alternatively, increases in pressure within operating conduit 130 can open flapper disc 122 by displacing a tubing mandrel (not shown) through flow bore 126 to thrust disc 122 open. Alternatively still, operating conduit 130 can include an electrical conductor configured to actuate a downhole motor capable of displacing flapper disc 122 into an open position.

In addition to an operating conduit 130 located within bore of production tubing 102, safety valve assembly 100 also preferably includes a bypass-conduit 140. Bypass-conduit 140 can be of various sizes, shapes, and types and can perform various types of functions, but bypass-conduit 140 is configured to communicate with lower zone 110 regardless of the position (open or closed) of flapper disc 122. Bypass-conduit 140 can be a straight, curved or otherwise tortuous conduit and is not limited to the shape shown in FIG. 1. Functions of bypass-conduit 140 can include, but are not limited to, the performance of chemical injection, gas lift, fiber-optic measurement, pumping, and logging operations. Chemical injection operations can include the injection of a foam, acid, surfactant, miscellar solution, corrosion inhibitor, scale inhibitor, hydrate inhibitor, paraffin inhibitor, or any other chemical injection intended to increase the quality and/or quantity of production fluids flowing to the surface. Depending on the type of operation to be performed by utilizing bypass-conduit 140, the construction and size of bypass-conduit 140 can vary from a small capillary for chemical injection to a 1.9" logging conduit, or larger. Although bypass-conduit 140 is shown as larger than operating conduit 140, the invention is not so limited to any relative sizes as shown in the figures. The term capillary tube is used to describe any small diameter tube and is not limited to a tube that holds liquid by capillary action nor is there any requirement for surface tension to elevate or depress the liquid in the tube. The term hydraulic and hydraulically are used to describe water or any other fluid and are not limited to a liquid or by liquid means, but can be a gas or any mixture thereof.

Regardless of its function and configuration, bypass-conduit 140 is preferably configured to only allow communication from the bore of bypass-conduit 140 to zone 110 and not from zone 110 to bypass-conduit 140. In embodiments using bypass-conduit 140 for fluid communication, a check valve device (not shown) is appropriate. For applications where a logging tool is deployed to zone 110 utilizing bypass-conduit 140, a hydraulic packoff (not shown) is appropriate. Nonetheless, conduit 140 can extend from a surface location, through the bore of tubing 102, through safety valve assembly 100 and communicate with zone 110 (including production zone 112 below) independent of the position (open, closed, or therebetween) of the flapper disc 122.

Figure 2:
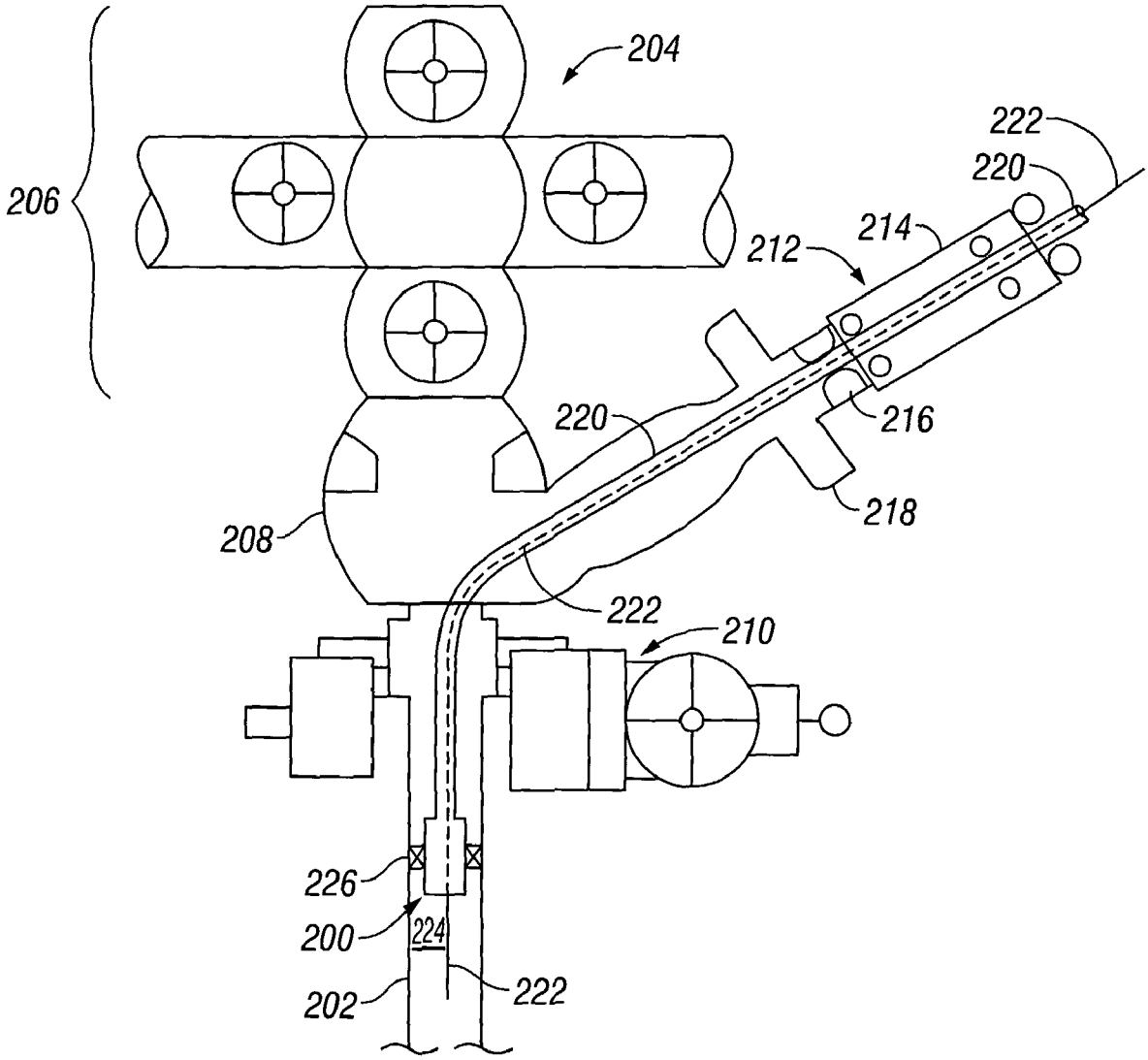
FIG. 2 is a schematic representation of a tubing injector assembly having installed a safety valve assembly with a bypass-conduit in a pre-existing string of production tubing in accordance with another embodiment of the present invention.

Referring now to FIG. 2, the installation of a safety valve assembly 200 into a pre-existing string of tubing 202 is shown. A wellhead assembly 204 is shown having a valve tree 206, a Y-spool adapter 208, a ram-type blowout preventer 210, and a dual-tubing injection assembly 212. Y-spool adapter 208 connects injection assembly 212 to valve tree 206 and blowout preventer 210 and enables the engagement of safety valve assembly 200 into the well. Injection assembly 212 includes a dual tubing injector head 214, a dual tubing hydraulic packoff 216, and a dual tubing annular blowout preventer 218. Although dual tubing is shown, a single tube can be used without departing from the spirit of the invention. The conduits can have separate injection means and are not limited to the bypass-conduit 222 being internal to the operating conduit 220. Safety valve assembly 200 is deployed inside production tubing 202 upon the distal end of two conduits, an operating conduit 220 and a bypass-conduit 222. Safety valve assembly 200 includes a flow interruption device therein (not shown) and a bypass-conduit 222 therein.

Operating conduit 220 actuates a flapper valve disc (not shown) or other flow interruption device. Bypass-conduit 222 allows for communication with a zone 224 below safety valve assembly 200 within tubing 202 independent the position (open, closed, or therebetween) of the flow interruption device. As safety valve assembly 200 is lowered to a desired location within tubing string 202, surface reels (not shown) pay out substantially equal lengths of operating conduit and bypass-conduit, 220 and 222 respectively. Injector head 214 and hydraulic packoff 216 thrust and seal around conduits 220 and 222 to prevent escape of pressurized fluids from tubing string 202. When safety valve assembly 200 has reached its target depth within the tubing string 202, a packer element 226 is activated to seal off the portion 224 of tubing 202 below safety valve assembly 200 from the portion above safety valve assembly 200. Packer element 226 can act to anchor safety valve 200 in place and/or to hydraulically isolate the regions above and below safety valve 200. The activation of packer element 226 can be through any means known by one of ordinary skill in the art but may be activated through the pressurization of operating conduit 220. With the safety valve assembly 200 in place and packer element 226 set, operating conduit 220 is capable of opening and closing a flow interruption device (not shown) within valve assembly 200 and furthermore bypass-conduit 222 is capable of communicating with region 224 below safety valve 200 when the flapper disc is closed or open. Operating conduit 220 can be constructed as two strings of hydraulic tubing, whereby one string supplies the energy to open the flow interruption device (not shown) within valve assembly 200 and the second string supplies the energy to close the flow interruption device (not shown) of valve assembly 200. Although the term flapper disc is used for illustrative purposes, the flow interruption device can be other non-disc shapes. The valve is not limited to flapper devices and can contain any flow interruption device know to those in the art. An operating conduit (or one or more strings of hydraulic tubing comprising operating conduit) could also be extended from the surface to safety valve 200 outside the bore of tubing 202. Finally, a string of bypass-conduit 222, operating conduit 220, or tubing 202 can be any combination of concentric or non-concentric configurations.

Furthermore, while the installation of safety valve 200 is shown into a pre-existing string of tubing 202 hung within a well, it should be understood by one of ordinary skill in the art that safety valve 200 can be an integral component of tubing 202 and run simultaneously therewith. Such an operation can include the simultaneous injection of tubing 202, and conduits 220 and 222 into the wellbore, for example through injection assembly 212. Once in location, tubing 202 can be cut and hung from wellhead assembly 202 using methods and apparatus known to those skilled in the art.

Figure 3:
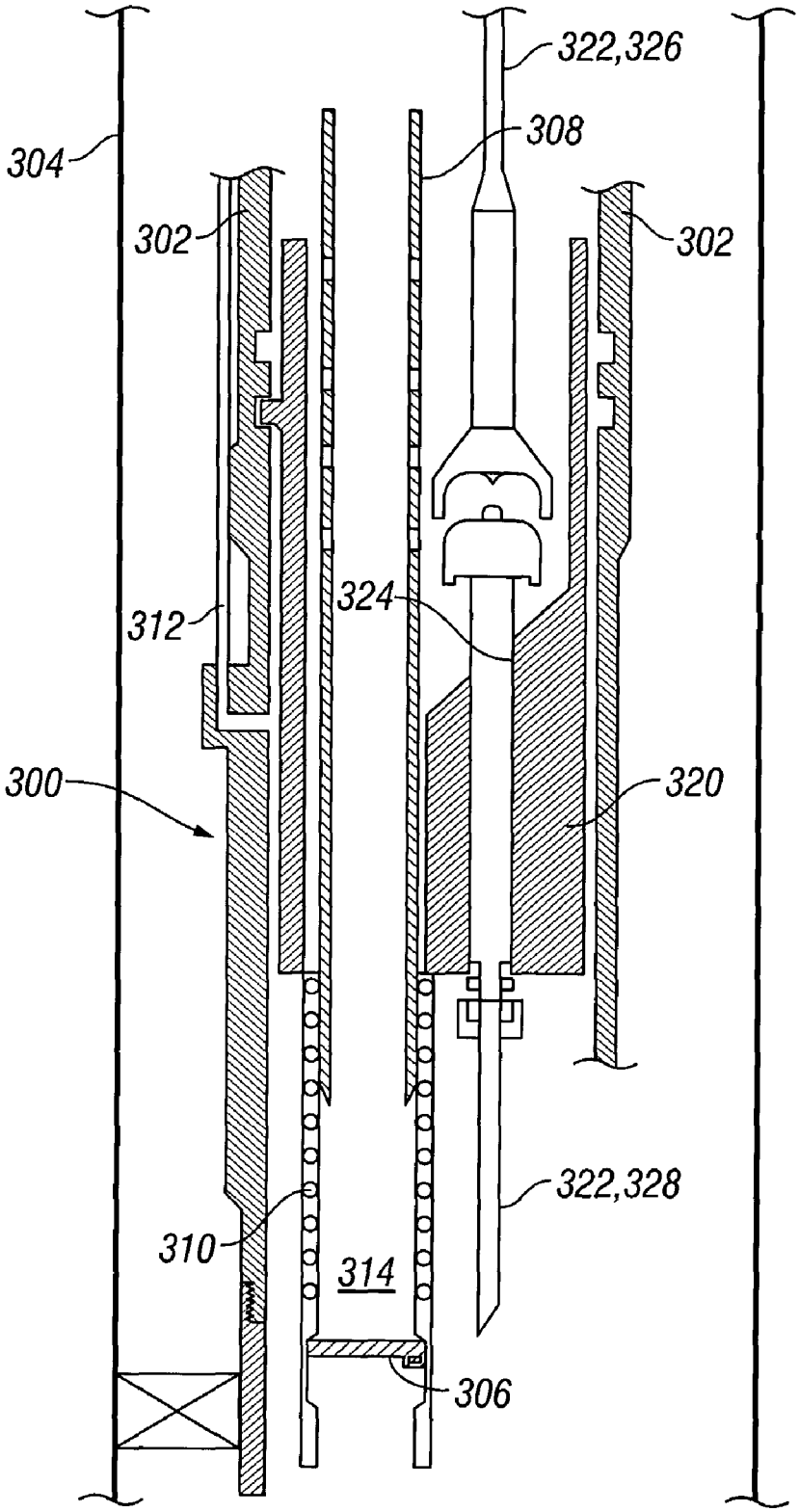
FIG. 3 is a schematic representation of a safety valve assembly with a bypass-conduit in accordance with another embodiment of the present invention.

Referring now to FIG. 3, another embodiment of a safety valve assembly 300 is shown schematically deployed in a string of production tubing 302 within a cased wellbore 304. Safety valve assembly 300 includes a flapper disc 306 operable from a closed position (shown) to an open position (not shown) to regulate the flow of fluids from below safety valve assembly 300, through operating mandrel 308 and to upper portions of production tubing 302. Biasing spring 310 biases operating mandrel 308 away from flapper disc 306, thereby keeping it closed. A hydraulic line 312 extends from a surface station and is used to actuate (not shown) operating mandrel 308 against force of spring 310 and into engagement with flapper element 306. With operating mandrel 308 engaging the flapper disc 306 open, a clearance bore 314 therethrough is opened and fluids and/or tools are able to flow therethrough.

Ordinarily, flapper disc 306 (when closed), operating mandrel 308, and any supporting components would consume the entire bore of production tubing 302. However, safety valve assembly 300 also includes a bypass-conduit 322 configured to allow communication from a zone above safety valve assembly 300 to a zone below safety valve assembly 300 regardless of the position of flapper disc 306. Therefore, in safety valve assembly 300 shown in FIG. 3, the flapper disc 306 and supporting components consume less than the full inner diameter of production tubing 302, with a bulkhead 320 occupying the remainder. Bulkhead 320 can be constructed as an integral part of a main body of safety valve assembly 300 or can be a separate component, designed to isolate a small flapper valve disc 306 from a larger string of production tubing 302. Nonetheless, bulkhead 320 provides a throughway 324 for a bypass-conduit 322. As mentioned above, bypass-conduit 322 can be of any design or configuration but is shown as a capillary tube for hydraulic injection below safety valve assembly 300. Bypass-conduit 322 is typically constructed with an upper portion 326 and a lower portion 328, wherein upper portion 326 communicates with a surface station and lower portion 328 is in communication with a production zone below. Furthermore, as shown in FIG. 3, bypass-conduit 322 can be constructed so that upper portion 326 and lower portion 328 are capable of being connected (not shown) and disconnected (shown) while safety valve assembly 300 is located downhole. To prevent fluid from flowing from a zone below the safety valve assembly 300 to the surface through bypass-conduit 322, check valves (not shown) can be included in the bypass-conduit 322 below safety valve 300, above safety valve 300, or both.

Figure 4:
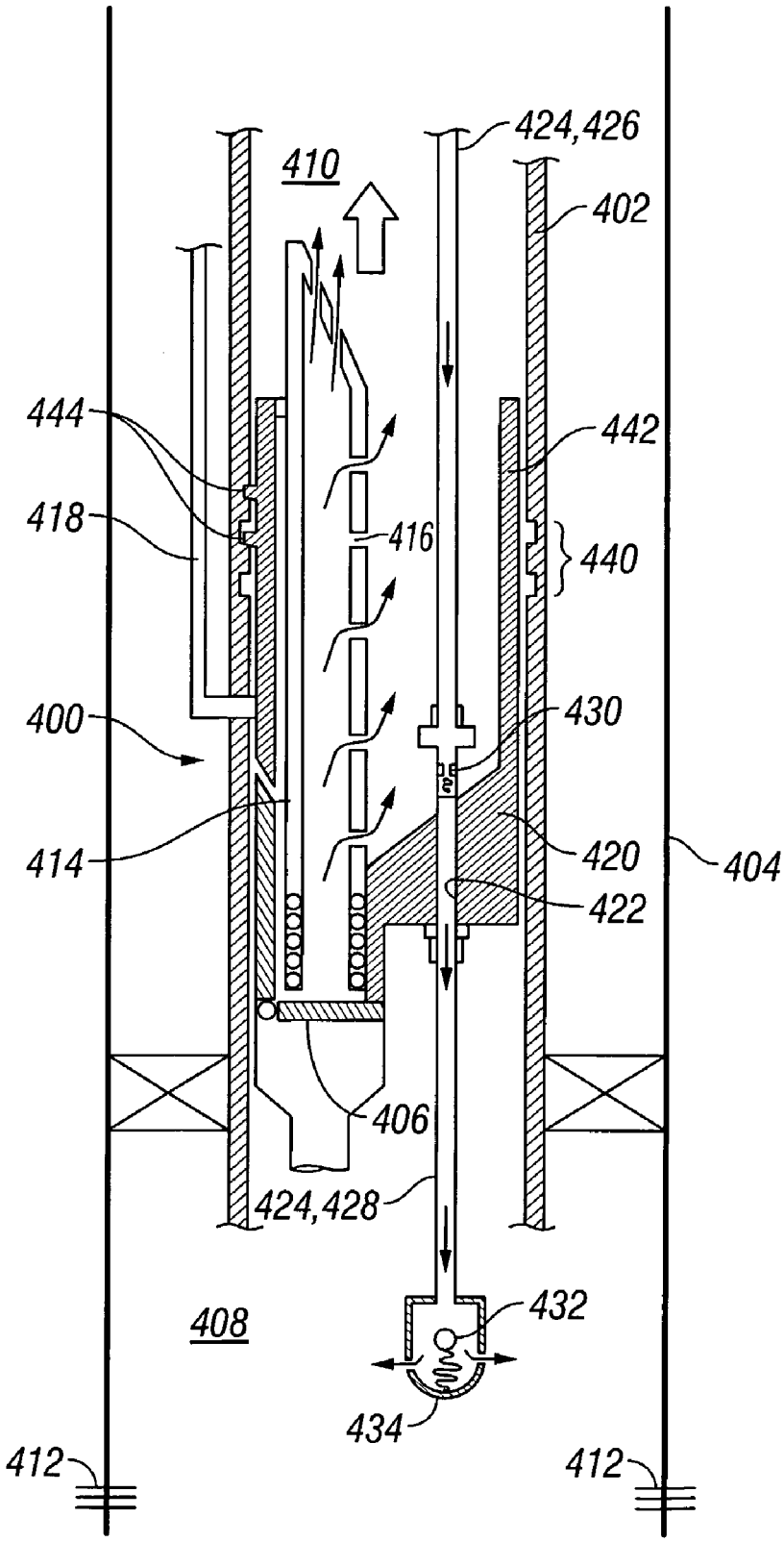
FIG. 4 is a schematic representation of a safety valve assembly with a bypass-conduit in accordance with another embodiment of the present invention.

Referring now to FIG. 4, another embodiment of a safety valve assembly 400 is shown schematically deployed in a string of production tubing 402 within a cased wellbore 404. Safety valve assembly 400 includes a flapper disc 406 operable from a closed position (shown) to an open position (not shown) to regulate the flow of production fluids from a production zone 408 below safety valve 400 to the bore 410 of production tubing 402 above safety valve 400. Production fluids can enter the cased wellbore 404 through perforations 412 in a production zone, flow past flapper disc 406 if open (not shown), through an operating mandrel 414 and into bore 410 of production tubing 402. Apertures 416 of operating mandrel allow for the free flow of production fluids from inside operating mandrel 414 to bore 410. As above, a hydraulic operating line 418 can extend from a surface location to operate mandrel 414 in and out of engagement with flapper disc 406 to open or shut safety valve assembly 400.

Furthermore, safety valve assembly 400 includes a bulkhead 420 which can provide a throughway 422 to allow a bypass-conduit 424 which can communicate between a production zone 408 and a surface location independent of the position (open or closed) of flapper disk 406 (shown closed). As above, bypass-conduit 424 can be constructed as any type of hydraulic, pneumatic, electrical, mechanical, or fiber-optic communication mechanism, but is shown here as a hydraulic injection conduit. Bypass-conduit 424 is preferably configured to allow the injection of a chemical substance and/or foam into a production zone to improve the production characteristics thereof. Injection conduit 424 of FIG. 4 includes two check valves, one 430 above bulkhead 420, and another check valve 432 incorporated into an injection head 434 below safety valve assembly 400. The invention is not limited to having a check valve or only having two check valves.

Furthermore, safety valve 400 is configured to be capable of being inserted and retrieved from string of tubing 402 after the tubing 402 is deployed to a depth of interest in the cased wellbore 404. Tubing string 402 can include a locking nipple 440 in its inner bore 410 at a location where a safety valve assembly 400 would be desired. The outer profile of main body 442 of safety valve assembly 400 would provide locking dogs 444 configured to be received by and retrieved from corresponding locking nipple 440. The valve can be connected to the tubing using any connective means known in the art. Using the removable configuration, a defective safety valve assembly 400 could be retrieved from the downhole location, repaired (or re-configured), and replaced within a short period of time, making repair operations less costly and more feasible for low production wells.

While the invention has been described with respect to a limited number of embodiments, those skilled in the art will appreciate numerous modifications and variations therefrom. It is intended that the appended claims cover all such modifications and variations as fall within the true spirit and scope of the invention.

What is claimed is:

1. A valve comprising:

a flow interruption device operable between an open position and a closed hydraulically sealed position; and a bypass-conduit extending from a surface location through the valve to a zone below said valve, said bypass-conduit wholly contained within a bore of a string of tubing carrying said valve, wherein said bypass-conduit is configured to be in communication with the surface location and the zone below said valve when said flow interruption device is in said closed hydraulically sealed position.

2. The valve of claim 1 wherein the valve is a subsurface safety valve.

3. The valve of claim 1 wherein the valve is a storm choke valve.

4. The valve of claim 1 wherein the zone below said valve is a production zone.

5. The valve of claim 1 wherein said flow interruption device is a flapper.

6. The valve of claim 5 wherein said flapper is pivotably operable between said open position and said closed hydraulically sealed position.

7. The valve of claim 1 further comprising an operating conduit in communication with a source of an energy, said operating conduit extending from the surface location to the valve and said energy actuating said flow interruption device from said closed hydraulically sealed position to said open position.

8. The valve of claim 1 wherein said bypass-conduit is a capillary tube.

9. The valve of claim 8 wherein said capillary tube is a fluid injection capillary tube in communication with the surface location and the zone below said valve.

10. The valve of claim 9 wherein said fluid comprises a liquid.

11. The valve of claim 9 wherein said fluid comprises a gas.

12. The valve of claim 9 wherein said fluid is selected from the group comprising surfactant, acid, miscellar solution, corrosion inhibitor, scale inhibitor, hydrate inhibitor, and paraffin inhibitor.

13. The valve of claim 1 wherein said bypass-conduit is a logging conduit.

14. The valve of claim 1 wherein said bypass-conduit is a gas lift conduit.

15. The valve of claim 1 wherein said bypass-conduit is an electrical conductor.

16. The valve of claim 1 wherein said bypass-conduit is an optical fiber.

17. The valve of claim 1 wherein said bypass-conduit is a hydraulic passage.

18. The valve of claim 17 wherein the bypass-conduit further comprises a check valve attached below the valve.

19. The valve of claim 17 wherein the bypass-conduit further comprises a check valve attached between the valve and a wellhead.

20. The valve of claim 7 wherein the operating conduit is a hydraulic passage.

21. The valve of claim 20 wherein the operating conduit further comprises a check valve located between the valve and a wellhead.

22. The valve of claim 7 wherein the energy supplied by the operating conduit actuates a packer element of the valve to an engaged position.

23. The valve of claim 7 wherein the energy supplied by the operating conduit actuates a packer element of the valve to a disengaged position.

24. The valve of claim 7 wherein the operating conduit is a continuous tube.

25. The valve of claim 7 wherein the operating conduit is a capillary tube.

26. The valve of claim 7 wherein said operating conduit and said bypass-conduit are concentric.

27. The valve of claim 7 wherein said operating conduit and the string of tubing are concentric.

28. The valve of claim 1 wherein said bypass-conduit and the string of tubing are concentric.

29. The valve of claim 7 further comprising a second operating conduit extending from the surface location to the valve, the second operating conduit in communication with the source of the energy, said energy actuating said flow interruption device from said open position to said closed hydraulically sealed position.

30. The valve of claim 29 wherein said second operating conduit extends from said surface location to the valve from outside the string of tubing.

31. A method to communicate with a zone below a valve, the method comprising:

installing a valve at a downhole location within a string of tubing;

connecting an operating conduit inside a bore of the string of tubing between the valve and a surface location;

extending a bypass-conduit wholly contained within a bore of a string of tubing carrying said valve from the surface location, through the valve, and to the zone below the valve;

selectively opening and closing a flow interruption device with the operating conduit; and communicating with the zone below the valve via the bypass-conduit when the flow interruption device of the valve is in a closed hydraulically sealed position.

32. The method of claim 31 wherein the valve is a subsurface safety valve.

33. The method of claim 31 wherein the flow interruption device is a flapper.

34. The method of claim 31 further comprising communicating with the zone below the valve through the bypass-conduit when the flow interruption device of the valve is in an open position.

35. The method of claim 31 wherein the bypass-conduit is a continuous tube.

36. The method of claim 31 wherein the bypass-conduit is a capillary tube.

37. The method of claim 31 further comprising constructing the bypass-conduit from a section of jointed pipe deployed from the surface location.

38. The method of claim 31 further comprising locating a check valve in the bypass-conduit above the valve.

39. The method of claim 31 further comprising locating a check valve in the bypass-conduit below the valve.

40. The method of claim 31 further comprising locating a check valve in the operating conduit.

41. The method of claim 31 further comprising injecting a foam to the zone below the valve through the bypass-conduit.

42. The method of claim 31 further comprising injecting a fluid to the zone below the valve through the bypass-conduit.

43. The method of claim 42 wherein the fluid is selected from the group consisting of corrosion inhibitor, scale inhibitor, hydrate inhibitor, paraffin inhibitor, surfactant, acid, and miscellar solution.

44. The method of claim 31 wherein the bypass-conduit is a logging conduit.

45. The method of claim 44 wherein a bore of the logging conduit is greater than one and a half inches in diameter.

46. The method of claim 31 wherein the bypass-conduit is a gas lift conduit.

47. The method of claim 31 wherein the bypass-conduit is an electrical conductor.

48. The method of claim 31 wherein the bypass-conduit is an optical fiber.

49. The method of claim 31 further comprising deploying the string of tubing, the bypass-conduit, the operating conduit, and the valve simultaneously.

50. The method of claim 31 further comprising deploying the valve, the bypass-conduit, and the operating conduit simultaneously into a pre-existing string of tubing.

51. The method of claim 31 wherein the valve is installed by actuating a packer element of the valve.

52. The method of claim 51 further comprising actuating the packer element with the operating conduit.

53. The method of claim 51 further comprising actuating the packer element with the bypass-conduit.

* * * * *